US009138870B2

(12) United States Patent
Eisenblaetter

(10) Patent No.: US 9,138,870 B2
(45) Date of Patent: Sep. 22, 2015

(54) ROTATIONALLY SYMMETRICAL TOOL FOR CUTTING MATERIAL SURFACES

(75) Inventor: Gerd Eisenblaetter, Geretsried (DE)

(73) Assignee: Gerd Eisenblaetter GmbH, Geretsried (DE)

( * ) Notice: Subject to any disclaimer, the term of this patent is extended or adjusted under 35 U.S.C. 154(b) by 309 days.

(21) Appl. No.: 13/559,867

(22) Filed: Jul. 27, 2012

(65) Prior Publication Data

US 2013/0025429 A1 Jan. 31, 2013

(30) Foreign Application Priority Data

Jul. 28, 2011 (DE) ..... 10 2011 108 859

(51) Int. Cl.
*B24D 9/08* (2006.01)
*B24D 13/14* (2006.01)
*B24D 18/00* (2006.01)

(52) U.S. Cl.
CPC *B24D 9/08* (2013.01); *B24D 13/14* (2013.01); *B24D 18/00* (2013.01); *Y10T 29/49826* (2015.01); *Y10T 83/9403* (2015.04)

(58) Field of Classification Search
CPC ..... A24D 9/085; B24B 37/22; B24B 37/24; B24B 37/245; B24B 37/26; B24D 3/002; B24D 9/08; B24D 11/02; B24D 11/06; B24D 18/0045; B24D 18/0072
USPC ..... 83/676; 451/461, 527, 529, 531, 532, 451/533, 534, 537, 538, 539, 548
See application file for complete search history.

(56) References Cited

U.S. PATENT DOCUMENTS

| | | | | |
|---|---|---|---|---|
| 5,405,286 | A * | 4/1995 | Welsch | 451/527 |
| 6,179,950 | B1 * | 1/2001 | Zhang et al. | 156/258 |
| 6,379,238 | B1 * | 4/2002 | Beechey et al. | 451/532 |
| 8,360,830 | B2 * | 1/2013 | Klug | 451/529 |
| 2013/0095735 | A1 * | 4/2013 | Zhang et al. | 451/531 |

* cited by examiner

*Primary Examiner* — Timothy V Eley
(74) *Attorney, Agent, or Firm* — Collard & Roe, P.C.

(57) ABSTRACT

A tool has disks or ring disks arranged for metal-cutting, which are stacked on top of each other in an overlapping fashion and engage into each other at their incisions which reach from the outer circumference up to the center point of the disks or the inner circumference of the ring disks. The incisions of the directly adjacent disks or ring disks are respectively angularly offset by 360°/n, with n being the number of the disks or ring disks. A production method is also provided for such a tool, in which the disks or ring disks are incised up to the center point or inner circumference, are completely slid into each other at the incisions, folded towards one another and displaced until an angular offset of the incisions of 360°/n is produced.

17 Claims, 7 Drawing Sheets

ROTATIONALLY SYMMETRICAL TOOL FOR CUTTING MATERIAL SURFACES

CROSS REFERENCE TO RELATED APPLICATIONS

Applicant claims priority under 35 U.S.C. §119 of German Application No. 10 2011 108 859.1 filed Jul. 28, 2011, the disclosure of which is incorporated by reference.

BACKGROUND OF THE INVENTION

1. Field of the Invention

The invention relates to a rotationally symmetrical tool for cutting material surfaces with several disks or ring disks arranged for metal-cutting, which comprise an incision originating from the outer circumference, comprise a common rotational axis and are stacked in a partly overlapping manner on top of one another in such a way that a portion of one respective disk or ring disk comes to lie on top through the incision of a disk or ring disk disposed above, with the incisions of the disks or ring disks being angularly offset. Furthermore, the invention relates to disks or ring disks with which the tool is arranged, and a method for the production of said tool.

2. Description of the Related Art

Generic rotationally symmetrical tools which are used for cutting material surfaces usually comprise one or several disks or ring disks with active metal-cutting properties. The cutting of material surfaces includes grinding, lapping, honing, polishing or mixed forms thereof. Active metal-cutting properties are then derived from grinding bodies, lapping means, polishing cloths or polishing pastes.

Rotationally symmetrical tools are known from the prior art, which comprise two circular ring disks which are interlocked in the manner of a fan. These tools are used in the grinding of tubes and boreholes or during deburring for example. As a result of several incisions in each ring disk, the tool is flexible and can adjust to the shape of the material surface. In order to interlock the ring disks, a first ring disk is provided with radial incisions and a second ring disk is cut to size in such a way that several trapezoidal segments of a circle are produced. The ring disks are placed on top of one another in such a way that they have a common rotational axis and the first ring disk comes to lie on the second one. The circle segments of the second ring disk are slid through the radial incisions of the upward first ring disk in such a way that circle segments of the second ring disk overlap the cover surface of the first ring disk and come to lie on the same.

The disadvantageous aspect of the tools known from the prior art is the low number of cover surfaces of the ring disks involved in the metal-cutting process, which is limited to two. Furthermore, production is very laborious because the shapes of the incisions differ in the two ring disks and the sliding and interlocking of the two multiply incised ring disks cannot be automated in a cost-effective manner.

SUMMARY OF THE INVENTION

It is therefore the object of the invention to provide a rotationally symmetrical tool for cutting which can be produced by a cost-effective and automated method that can be realized with few work steps and offers a higher material removal rate in combination with longer service life.

This object is achieved by the rotationally symmetrical tool in such a way that the incision reaches up to the center point of the disks or the inner circumference of the ring disks, and that the angular offset to the incision of the respectively next disk or ring disk is equal to $\alpha=360°/n$, with n being the number of the disks or ring disks. The object is achieved with respect to the method in that several disks or ring disks arranged for metal-cutting are incised from the outer circumference up to the center point of the disks or the inner circumference of the ring disks, the incisions of at least two disks or ring disks are slid completely into each other, the disks or ring disks are folded towards one another until their rotational axes are aligned coaxially with respect to one another, and finally the partly overlapping disks or ring disks are mutually twisted until an angular offset of the incisions of the respectively next disk or ring disk equal $\alpha=360°/n$ is reached, with n being the number of the disks or ring disks. Preferred further developments are discussed below.

It is provided in accordance with the invention that the rotationally symmetrical tool for cutting material surfaces is provided with several disks or ring disks arranged for metal-cutting. The disks or ring disks can be circular, elliptic, polygonal, rosette-like or star-shaped. When the disks or ring disks are completely slid into each other at their incisions and folded towards one another so that the cover surfaces (i.e. the upper and bottom sides of the disks or ring disks) touch one another and the rotational axes are coaxial and are thereafter mutually twisted, an overlapping stacking of the individual disks or ring disks is obtained. A portion of a disk or ring disk engages through the incision of the next upper disk or ring disk and comes to lie on its cover surface. The angular offset of the incisions of the directly adjacent disks or ring disks can be determined by twisting the disks or ring disks.

The invention comes with the advantage that only one incision is provided per disk or ring disk and said incision reaches up to the center point of the disk or the inner circumference of the ring disk, by means of which the disks or ring disks can be slid in a simple manner into each other and can be displaced against one another.

It is further advantageous that all disks or ring disks of a tool are evenly involved in the cutting process, which increases the material removal rate of the disks or ring disks and therefore increases the service life of the tool. The disks or ring disks are consumed by removal in areas which come into contact with the material surface during the cutting process. This always only affects the uppermost layer of the stacked and overlapping disks or ring disks. All disks or ring disks are involved in the uppermost layer, with the fraction of the cover surface of each disk or ring disk which forms the uppermost layer being equal to 1/n. This is in agreement with the angular offset of $\alpha=360°/n$ which the incisions of the respectively adjacent disks or ring disks have with respect to each other. Once the uppermost layer has been consumed by the cutting process, the next layer underneath which is again formed from the stacked and overlapping disks or ring disks will be removed. In the case of constant wear, the ratio of the surface fractions of the cover surfaces active in the cutting will not change, which means it will remain at 1/n. Since the tool needs to be fitted with new disks or ring disks only after the consumption of all disks or ring disks, longer service life is ensured in comparison with tools which are covered with one disk or covered with only few disks or ring disks.

A preferred embodiment of the invention is that the number of the disks or ring disks is three to six and preferably four to five. The larger the number of the stacked and overlapping disks or ring disks, the longer the active cutting properties of the disks or ring disks can be used before an exchange will become necessary.

Principally, the incision can be a thin slit, with the cover surface of the disk or ring disk being maintained completely.

The incision can also be produced in such a way that a portion of the cover surface of the disks or ring disks is cut away. The shapes of the incisions of the disks or ring disks can vary widely, e.g. they can be straight, arc-shaped or wave-like, linear, rectangular, triangular or trapezoidal. In accordance with a preferred further development of the invention, the incisions will widen towards the outer circumference. This means that the width of the incision or the cut shape will increase from the center point of the disk or the inner circumference of the ring disk up to the outer circumference. This is advantageous in that the disks or ring disks can be slid into each other and twisted more easily because there will be less friction between the disks or ring disks among each other. This is especially useful when many disks or ring disks need to be twisted with each another. Usually, the incision of at least one disk or ring disk at the narrowest point is at least wide enough to allow for n−1 stacked disks or ring disks to be pushed into the incision.

The incisions of the rings can principally extend radially or tangentially from the outer circumference to the inner circumference. In an especially preferred variant, the incisions will extend radially to the inner circumference. A radial incision extends from the outer circumference up to the centric opening of the ring, with the extension of the incision ending at the imaginary center point of the ring disk. A tangential incision also reaches from the outer circumference up to the ring opening, but the extension of the incision does not meet the imaginary center point but ends adjacent to the center point. Radial incisions offer the advantage that they are shorter than tangential incisions. As a result, there is a lower likelihood that the mutually stacked disks or ring disks will get jammed as a result of the incisions at high rotational speed, or that the transitional points of mutually stacked disks or ring disks will right up at the incisions.

In a preferred embodiment, the disks or ring disks comprise adjusting aids which determine the angular offset. The adjusting aids are arranged on the disks or ring disks in such a way that they determine the adjustment and therefore the angular offset of the incisions during displacement of the disks or ring disks. The adjusting aids can be based on a specific shape or color such as punched portions or marking points. The measurement of the angular offset will become superfluous due to the adjusting aids because said angular offset will inevitably be set by the alignment of the disks or ring disks on the adjusting aids.

Principally, the adjusting aids can be disposed at any location of the disks or ring disks. The adjusting aids can be provided in form of marking points on the outer circumference. However, they can also occur in the cover surface of the disks or ring disks in form of punched portions or perforations. In an especially preferred variant, the adjusting aids are disposed on the inner circumference of the rings. For example, the adjusting aids can be arranged as a straight side of an otherwise circular centric ring opening.

In a further especially preferred embodiment, the adjusting aids of the individual disks or ring disks together form an adjusting pattern, which will only be obtained if the alignment of the disks or ring disks corresponds to the angular offset of the incisions. Thus, when stacking the disks or ring disks on top one another, the angular offset of the incisions can be produced by twisting the disks or ring disks until the adjusting pattern appears. The adjusting pattern can be a perforation for example which is brought to fully overlap in all disks or ring disks. In this process, each of the mutually stacked disks or ring disks comprises a circular perforation in its cover surface. The perforations are arranged on a circular circumference which is equally distant from an imaginary center point on the individual disks or ring disks and only differs in respect of their position to the respective incision of the disk ring disk. When the disks or ring disks are twisted until the perforations of all disks or ring disks fully overlap each other, i.e., the adjusting pattern has been obtained, the angular offset of 360°/n has been set.

In the event that the adjusting aids are formed as straight sides of otherwise circular centric ring openings, the angular offset of the incisions is obtained when after the displacement of the ring disks the adjusting aids or the centric ring openings of all ring disks jointly assume a polygonal shape. The precondition for this is that all ring disks have the same configuration, which means that the centric openings are provided with the same shape and the incisions are located at the same place in all ring disks. If the centric ring openings are arranged with a non-rotationally symmetrical shape, e.g. as a semicircle, the incisions in the individual ring disks respectively need to be offset by a specific angle in relation to the respective adjusting aid (the straight side of a semicircle for example) in order to produce the angular offset of the incisions by means of the adjusting pattern (a semi-circular ring opening which is matched so as to fully overlap in all disks or ring disks).

The production of the rotationally symmetrical tool with the disks or ring disks can be automated with the help of the adjusting aids or the resulting adjusting patterns. Mounting or bearing supports are used for the purpose of aligning the disks or ring disks on the adjusting aids according to the angular offset. The subsequent measurement of the angular offset can be avoided by using the adjusting aids.

In order to prevent fluttering of the disks or ring disks during rotating operation of the tool, it is appropriate to glue the disks or ring disks together at least in part. In a preferred further development, the adhesive is applied at certain points close to the incision of a disk or ring disk. This can be provided as a point-like application or in form of a bead. Planar coating of the disks or ring disks is principally not necessary in order to prevent fluttering in operation. Suitable adhesives are polyurethane, cold or hot adhesives for example.

Principally, the disks or ring disks are provided with active cutting properties at least on one of their cover surfaces, i.e. the upper or bottom side. A preferred variant of the invention provides active cutting properties both for the upper as well as the bottom cover surface of the disks or ring disks. This arrangement comes with the advantage that both the uppermost and lowermost cover surface of the stacked disks or ring disks are involved in the cutting process. This can be especially useful when the tool is used for machining grooves, flutes, boreholes, slits or the inside diameter of a tube. Surfaces of the disks or ring disks with active cutting properties will meet the material surface both during insertion and withdrawal of the tool. The tool will automatically adjust to the shape of the material surface as a result of the flexible disks or ring disks.

The materials which are responsible for the active cutting properties of the disks or ring disks differ depending on the field of application. Preferably, at least one of the disks or ring disks comprises a nonwoven or felt material in accordance with the invention. Both the nonwoven and the felt material are suitable for the preliminary polishing of soft materials such as aluminum, brass or copper, because the surface roughness of the material surface will be reduced and smoothing will be achieved. The mirror finish of the material surface is achieved by using the nonwoven material in combination with polishing pastes and creams. Foamed, highly refined nylon nonwoven is used on the other hand for grinding, finishing grinding, descaling, removal of oxides, scratches, rust, burrs and paint from metals, wood and plastic. Grain-distributed coarse nylon fabric is used for cleaning and descaling weld seams, and cleaning metals and wood. Disks or ring disks made of cotton are used for polishing soft metals together with polishing pastes and creams.

Furthermore, preferably at least one disk or ring disk consists of a support and a material machining coating. The disk or ring disk is provided with stability by the support. The support can consist of nylon, polyester, cotton or mixed fabric, vulcanized fiber or knitted hemp, flax or sisal fabric.

The material machining coating can principally consist of an abrasive agent, nonwoven material, felt material, or a polishing cloth. An especially preferred further development is provided with a material machining coating which consists of an abrasive with a grit of 35 to 60 (ISO 6344). This grit of the abrasive comes with the advantage of ensuring high removal in combination with low damage to the material surface. The abrasives are bonded to the support by using predominantly ceramic, polymer or metal bonding agents. Abrasives to be considered are oxidic cutting ceramics, diamond particles, silicon carbide, corundum or zircon. Preferably, the abrasive comprises ceramic components which in pure or mixed form consist of aluminum oxides, zirconium oxide, titanium carbide, zirconium corundum or silicon carbides. The use of abrasives with ceramic components as a material machining coating produces an especially high removal rate in the tool in accordance with the invention because the grinding angle obtained between the tool and the surface of the material is acute as a result of the overlapping, mutually stacked disks or ring disks.

In a further preferred embodiment, the active cutting properties of at least two disks or ring disks differ from one another. It is therefore possible to combine an abrasive disk with a nonwoven disk, which leads to the consequence that the uppermost cover layer which is involved in the cutting process consists of two different materials and has different active cutting properties. Processing steps in metal-cutting of a material surface by a tool can be combined with this arrangement without requiring an exchange of the disks or ring disks or of the tool.

In a further embodiment in accordance with the invention, the disks or ring disks are arranged on a supporting disk. As a result of the support of the disks or ring disks by a supporting disk, the tool will become more stable and the force required for the metal-cutting process which is applied to the tool for machining the surface can be transmitted in this way more efficiently to the material surface. The disks or ring disks are fixed with an adhesive to the supporting disk, which adhesive has a residual elasticity. The adhesive can be provided on the basis of polyurethane or can be a hot or cold adhesive.

In an especially preferred embodiment, the disks or ring disks are attached to the supporting disk by a detachable adhesive or a hook-and-loop fastener. This facilitates and accelerates the mounting of the disks or ring disks on the supporting disk when an exchange becomes necessary.

The supporting disk is connected via a clamping system, a flange or a thread with a drive shaft of a drive machine such as an angle grinder. The tool in accordance with the invention offers the advantage that it is possible to work at a speed of the drive machine in the range of 50 to 80 m/s (DIN EN 13743). Optimal performance and service life of the tool is achieved at a speed of 63 m/s.

Principally, the supporting disk can consist of different materials. Vibration-damping and noise-damping plastic materials such as polyurethanes or acrylonitrile butadiene styrene are used for example. It is appropriate to use free-machining materials which are easy to trim and wear off automatically during the machining of the surface. Such a material is a plastic such as acrylonitrile butadiene styrene for example. In a preferred embodiment, the supporting disk comprises natural fibers which can easily be disposed of after use. Such a supporting disk can be made of granulates for example by way of an injection molding method, with the granulate consisting of hemp fibers or cellulose in a bonding agent. It is also possible to use a plastic supporting disk which is reinforced with natural fibers.

For the production of a rotationally symmetrical tool in accordance with the invention for cutting material surfaces, the disks or ring disks are preferably pre-sorted into stacks before being slid into each other. The sliding of the disks or ring disks into each other then occurs in stacks, which substantially facilitates the production of the tool. In a preferred further development, the sequence which the future stacked disks or ring disks slid into each other will have is determined by preceding sorting within the stack. The folding together towards one another then determines the final sequence of the two stacks and therefore of all disks or ring disks.

In order to prevent fluttering of the disks or ring disks during rotating operation, adhesive is applied close to the incisions of the disks or ring disks in some sections during the production of the tool. The adhesive can be applied before or after the production step in which the disks or in disks are slid into each other. The gluing in some sections can occur in form of individual adhesive points or adhesive beads. It is advantageous when a supporting disk is used to fix the disks or ring disks to the same by means of adhesive. The lowermost layer of the mutually stacked disks or ring disks is glued together with the upper side of the supporting disk. The adhesive can be applied either in some sections or in a planar fashion on the supporting disk or the disks or ring disks, or on both. Suitable adhesives are polyurethane, cold or hot adhesives.

BRIEF DESCRIPTION OF THE DRAWINGS

The invention will be described below in closer detail by reference to the five preferred embodiments shown in the drawings, which show schematically.

DETAILED DESCRIPTION OF PREFERRED EMBODIMENTS

Figure 1:
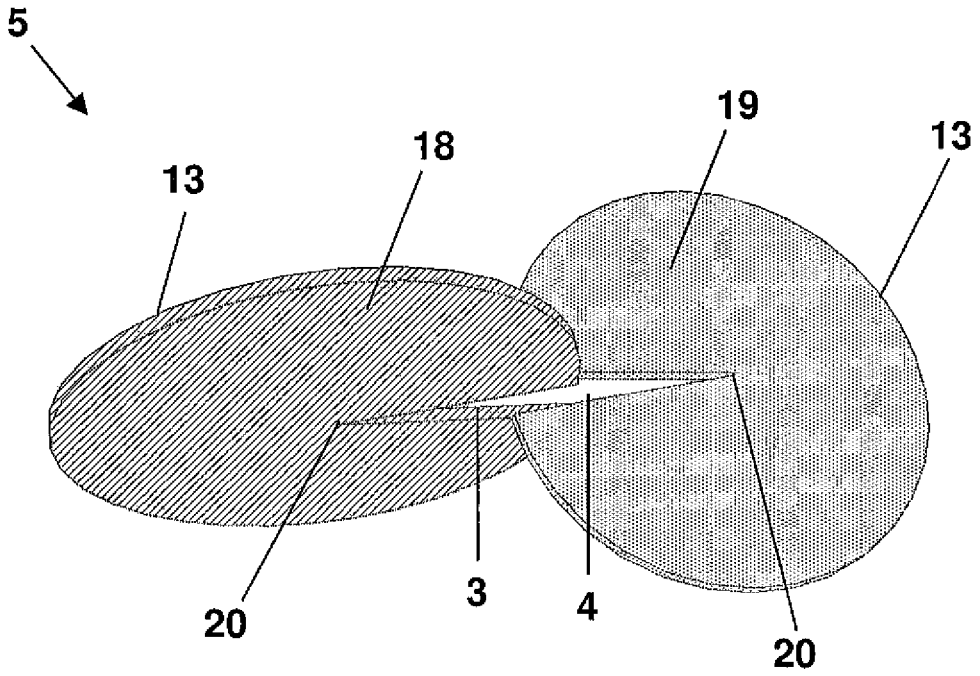
FIGS. 1 to 4 show a first tool with two disks in four different production steps in a perspective view.

The production of a first tool 5 with two (n=2) circular disks 18 and 19 arranged for cutting will be described below by reference to FIGS. 1 to 4. A first disk 18 and a second disk 19 respectively comprise an incision 3 and 4, which extends from the outer circumference 13 in a wedge-like manner up to the center point 20 of the respective disk 18 and 19. The width of the incisions 3 and 4 decreases from the outer circumference 13 to the center point 20. The disks 18 and 19 are arranged as abrasive disks, meaning that a polyester support is provided on one of its cover surfaces with ceramic grain. Even though the disks 18 and 19 are composed of the same material in this embodiment, an embodiment is possible in which the disks 18 and 19 consist of different materials.

Figure 2:
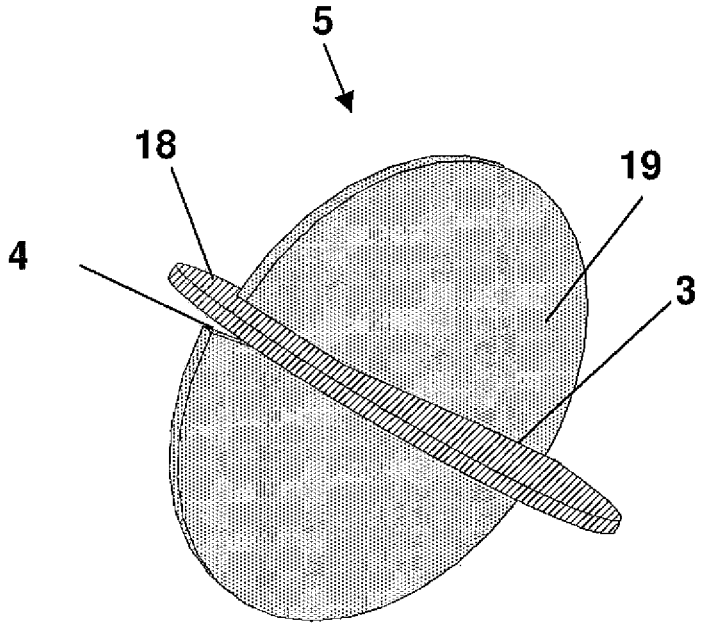

FIG. 1 illustrates the initial production step, in which the first disk 18 is introduced at its incision 3 into the incision 4 of the second disk 19. FIG. 2 shows the next production step, in which the first disk 18 has been slid completely into the incision 4 of the second disk 19, so that its outer circumference 13 is flush with the outer circumference of the second disk 19.

Figure 3:
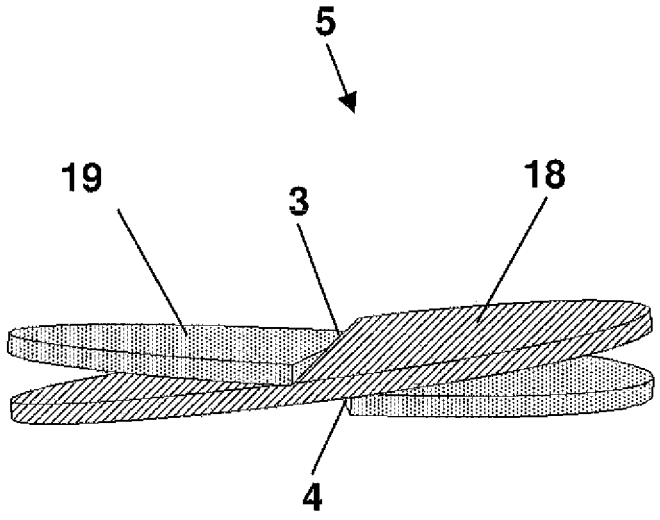
Figure 4:
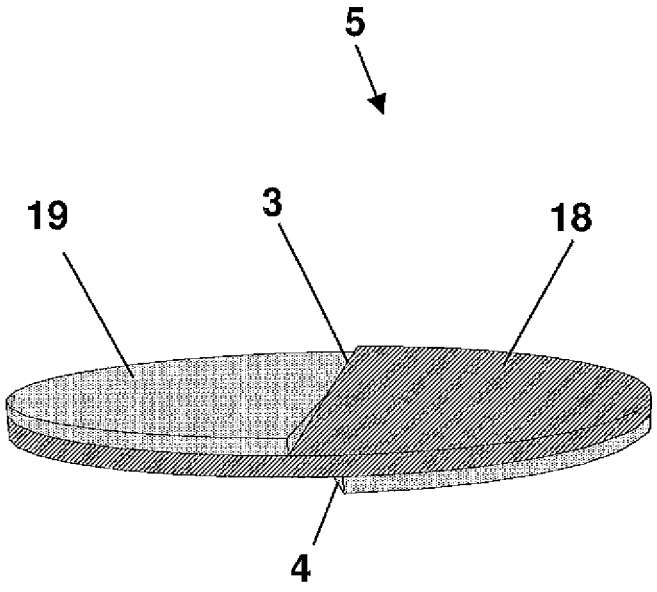

FIG. 3 shows the next production step, in which the two disks 18 and 19 which have been slid into each other are folded towards one another in such a way that they virtually come to lie on top of one another and the surfaces of the first disk 18 and the second disk 19 which are provided with abrasive grain show in the same direction. The end position of the mutually inserted and overlapping first and second disk 18 and 19 is shown in FIG. 4. The one half of the first disk 18 comes to lie above the second disk 19 and the other half comes to lie beneath the second disk 19. As a result, an angular offset of the incision 3 of the first disk 18 in relation to the incision 4 of the second disk 19 of $\alpha=360/n=360°/2=180°$ has been set in the tool 5.

Figure 5:
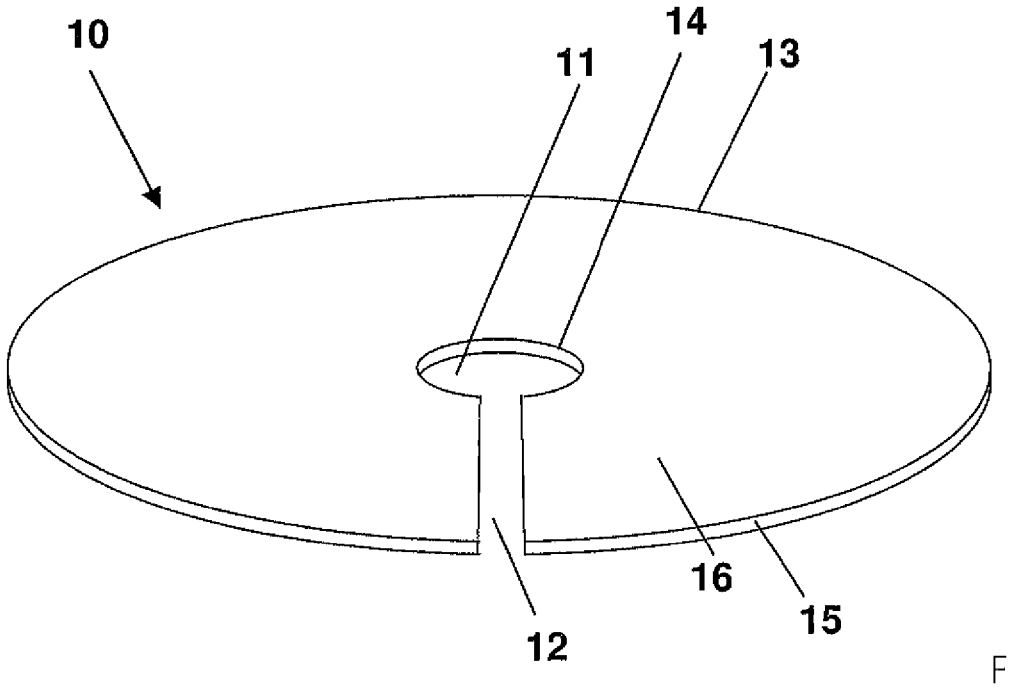
FIG. 5 shows a ring disk with an incision according to a first embodiment in a perspective view.

FIG. 5 shows a circular ring disk 10 arranged for metal-cutting according to a first embodiment with a circular centric opening 11. The ring disk 10 comprises a radially extending incision 12 of constant width which extends from the outer circumference 13 of the ring disk 10 up to its inner circumference 14. The ring disk 10 consists of a support 15 made of a cotton/polyester mix fabric and an abrasive agent as a material machining coating 16 which contains bonded ceramic grain.

Figure 6:
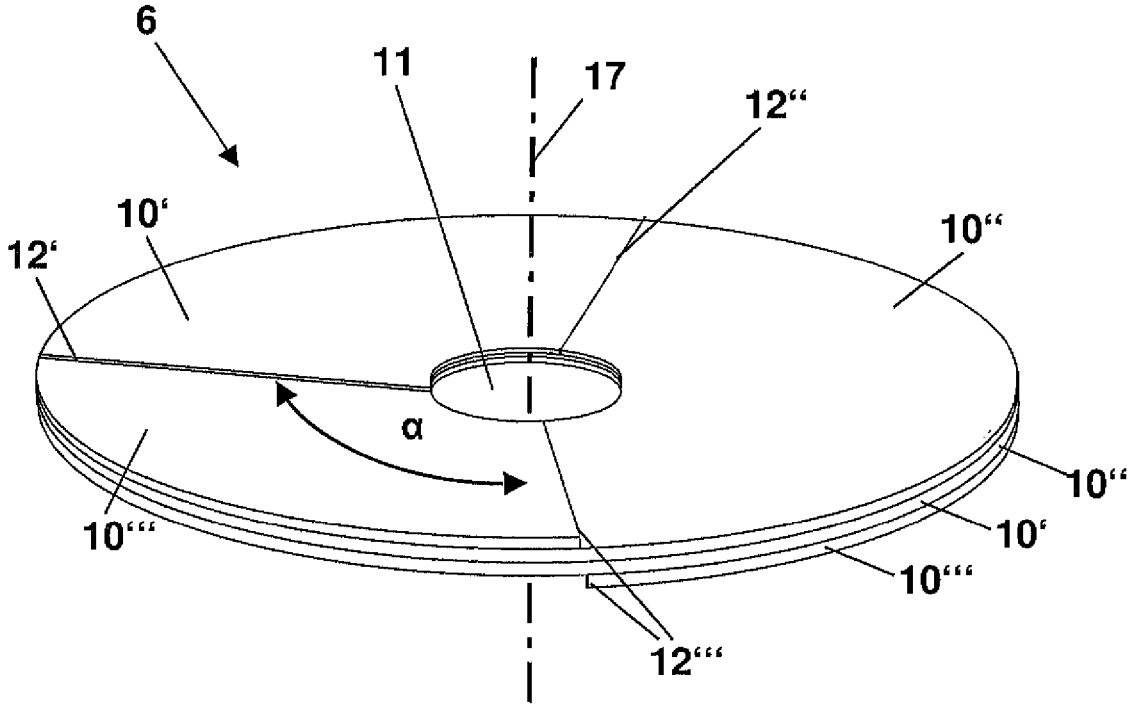
FIG. 6 shows a second tool with three mutually overlapping ring disks according to FIG. 5 in a perspective view.

FIG. 6 shows a second tool 6 which consists of three (n=3) mutually stacked and overlapping ring disks 10', 10" and 10'" according to FIG. 5. The production method of the tool 6 is performed in an analogous fashion to the production steps as shown in FIGS. 1 to 4. However, two ring disks 10' and 10" are slid simultaneously into the incision 12'" of the third ring disk 10'", folded towards one another and twisted against one another. The width of the incision 12'" is large enough for the ring disks 10' and 10", being placed on top of one another, to be slid into the incision 12'" at an angle of 90° to the ring disk 10'". The centric ring openings 11 facilitate the sliding into each other and the twisting of the ring disks 10', 10" and 10'" by reducing frictional forces which are produced during the production of the tool 6.

The three mutually inserted ring disks 10', 10" and 10'" comprise a common rotational axis 17, and both the ring openings 11 and also the outer circumferences 13 of the three ring disks 10', 10" and 10'" come to lie on top of one another. The ring disks 10', 10" and 10'" will engage into each other via their incisions 12', 12" and 12'", and are displaced against one another in such a way that an angular offset of $\alpha=360/n=120°$ is obtained between the incisions 12' and 12", 12" and 12'" and 12'" and 12'. As a result, the ring disk 10' engages through the incision 12'" and comes to lie on the ring disk 10'". The ring disk 10' is involved with one-third in the uppermost layer of the mutually stacked three ring disks 10', 10" and 10'", whereas two-thirds of the ring disk 10' are covered by the ring disks 10" and 10'" disposed above. Ring disk 10" engages through the incision 12' and comes to lie on the ring disk 10'. One-third of the ring disk 10" is involved again in the uppermost layer, whereas two-thirds of the ring disk 10" are covered by the ring disks 10'" and 10' disposed above. The same applies to ring disk 10'", which engages through the incision 12" and comes to lie on ring disk 10". Two-thirds of the ring disk 10'" are covered by the ring disks 10' and 10" disposed above and one-third of the ring disk 10'" is involved in the uppermost layer. The perspective view (FIG. 6) therefore only shows one-third of the ring disks 10', 10" and 10'" because two-thirds of the ring disks 10" and 10'", 10'" and 10' as well as 10' and 10" are covered. The entire cutting cover surface of the tool is provided with ceramic abrasive grain, with each ring disk 10', 10" and 10'" respectively constituting one-third of abrasive surface in the uppermost cover surface of the overlapping ring disks and thus participating in the metal-cutting process.

Figure 7:
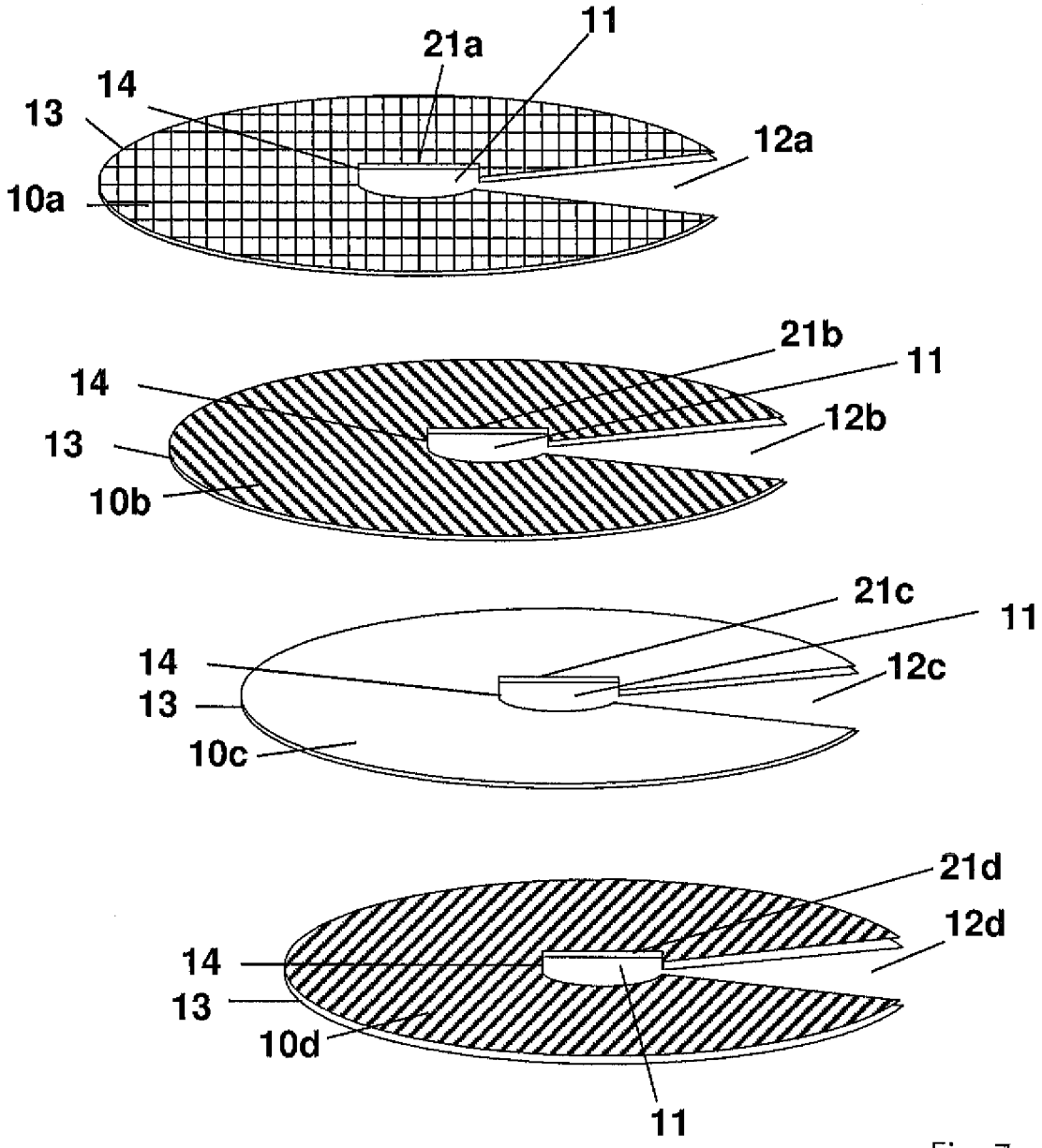
FIG. 7 shows four ring disks with adjusting aids according to a second embodiment in a perspective view.

FIG. 7 shows four circular ring disks according to a second embodiment, with the ring disks being arranged as a felt ring disk 10*a*, a grinding ring disk 10*b*, a nonwoven ring disk 10*c* and a polishing ring disk 10*d*. The felt ring disk 10*a* consists of a polyester support which is covered with a felt material. The grinding ring disk is arranged as a cotton support with corundum bonded in resin. The nonwoven ring disk 10*c* consists of a nonwoven material saturated with zirconium corundum, and the polishing ring disk 10*d* is a polishing cloth provided with a polishing paste. The ring disks 10*a* to 10*d* have the same configuration and all comprise a wedge-shaped incision 12*a* to 12*d* from the outer circumference 13 to the inner circumference 14. The otherwise circular centric openings 11 are respectively provided with a straight side, which are used as adjusting aids 21*a* to 21*d*. The adjusting aids 21*a* to 21*d* are disposed offset by 90° in relation to the respective incisions 12*a* to 12*d*. At their narrowest points where they run into the ring openings 11, the incisions 12*a* to 12*d* are wide enough to allow for two mutually stacked ring disks 10*a* to 10*d* to be slid perpendicularly thereto through the incision.

Figure 8:
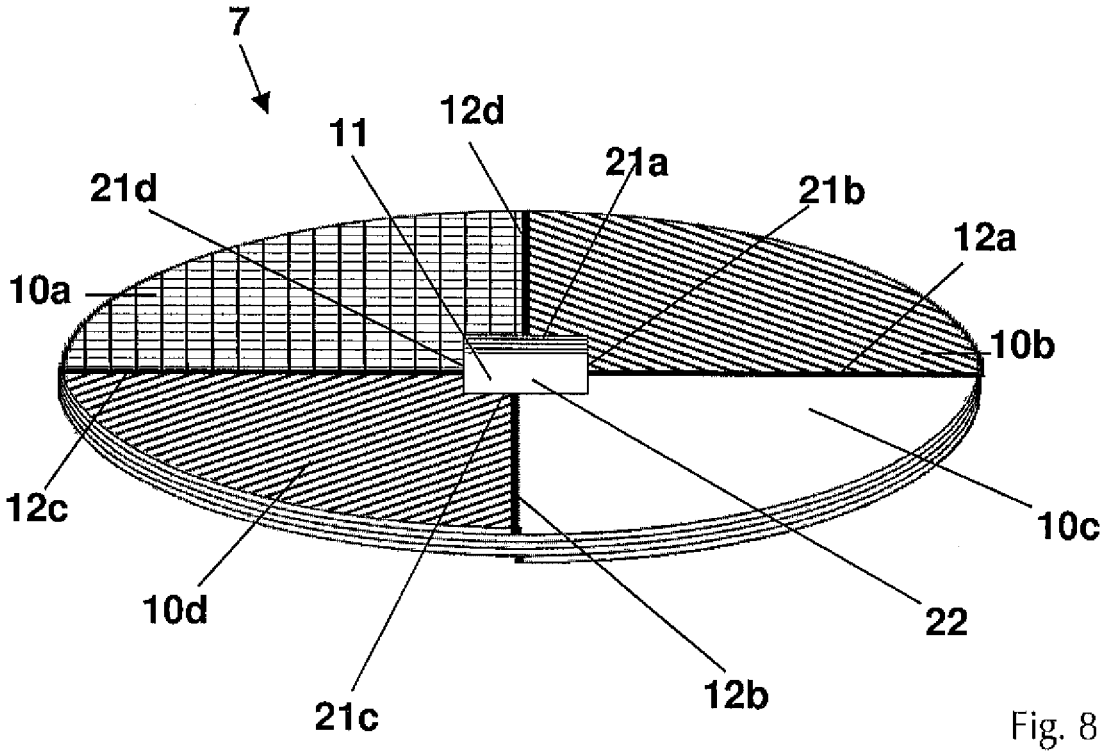
FIG. 8 shows a third tool with four mutually overlapping ring disks according to FIG. 7 in a perspective view.

In order to produce a third tool 7 according to FIG. 8 from the four ring disks 10*a* to 10*d*, both the felt ring disk 10*a* and the grinding ring disk 10*b* and also the nonwoven ring disk 10*c* and the polishing ring disk 10*d* are placed in two stacks (not shown) above one another in such a way that the centric ring openings 11 and the incisions 12*a* to 12*d* fully overlap one another in stacks. Thereafter, the stacks are slid into each other at their incisions 12*a* to 12*d* in the aforementioned manner and folded together as shown in FIGS. 1 to 4. This example illustrates that principally any combination of the ring disks 10*a* to 10*d* is easily possible depending on the respective application.

Once the ring disks 10*a* to 10*d* have been twisted against one another to such an extent that an angular offset of $\alpha=360/n=360°/4=90°$ has respectively been set between the incisions 12*a* and 12*b*, 12*b* and 12*c* as well as 12*c* and 12*d*, a square adjusting pattern 22 is obtained. The square shape is only obtained if the ring disks 10*a* to 10*d* have been twisted against one another in such a way that the adjusting aids 21*a* to 21*d* form a square with their otherwise circular ring openings 11. If the square adjusting pattern 22 is not obtained during the twisting of the ring disks 10*a* to 10*d*, ring disks 10*a* to 10*d* need to be displaced to such an extent into each other until the square ring opening 11 is obtained. The angular offset of 90° is then set between the incisions 12*a* to 12*d*, which means incision 12*a* is offset by 90° in relation to incision 12*b*, incision 12*b* is offset by 90° to incision 12*c*, incision 12*c* is offset by 90° to incision 12*d*, and incision 12*d* is offset by 90° again to incision 12*a*. As a result, ring disk 10*a* is visible to one-quarter and covered to three-quarters by the upper ring disks 10*b*, 10*c* and 10*d*. The remaining ring disks 10*b* to 10*d* are subject to the same layering scheme.

Figure 9:
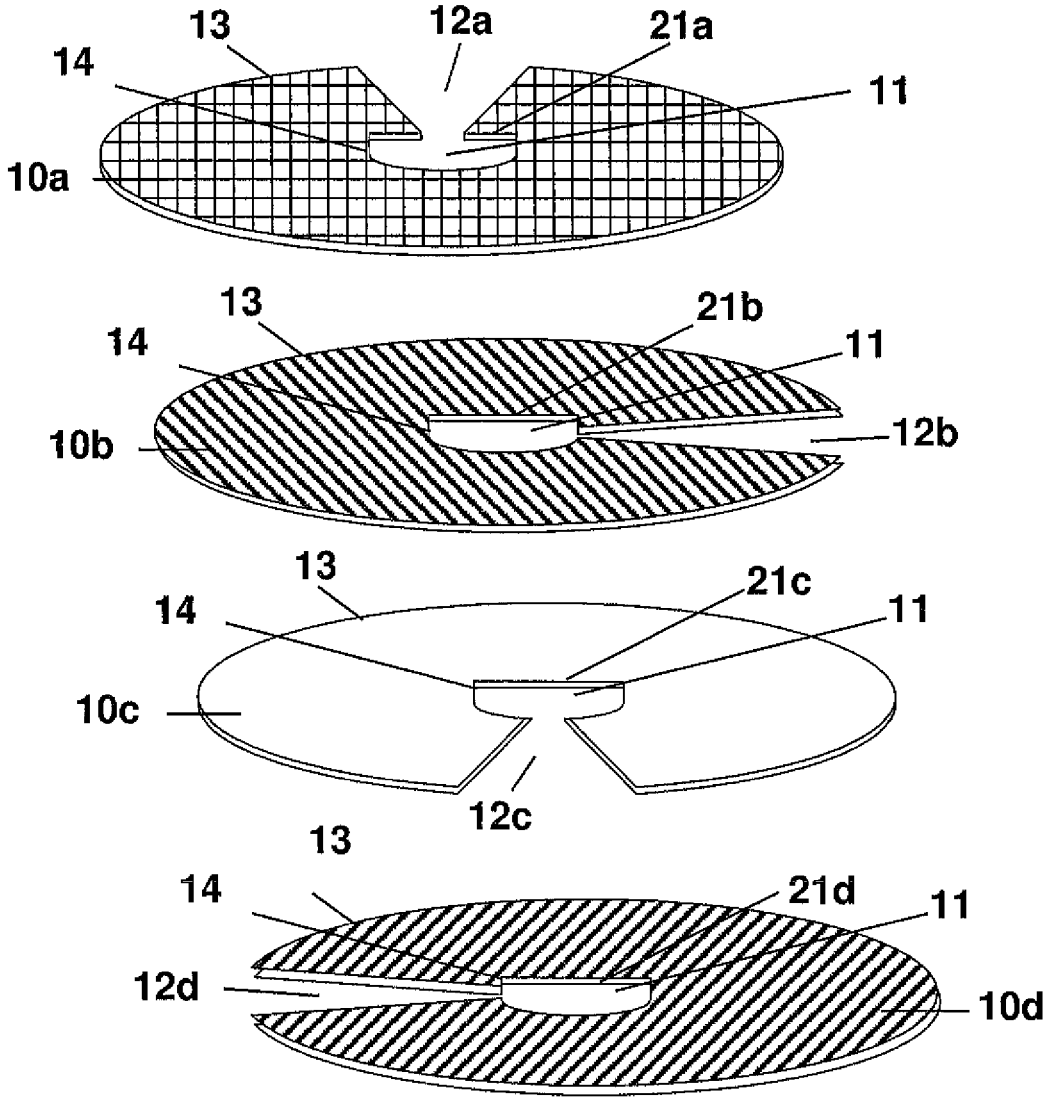
FIG. 9 shows four ring disks with adjusting aids according to a third embodiment in a perspective view.
Figure 10:
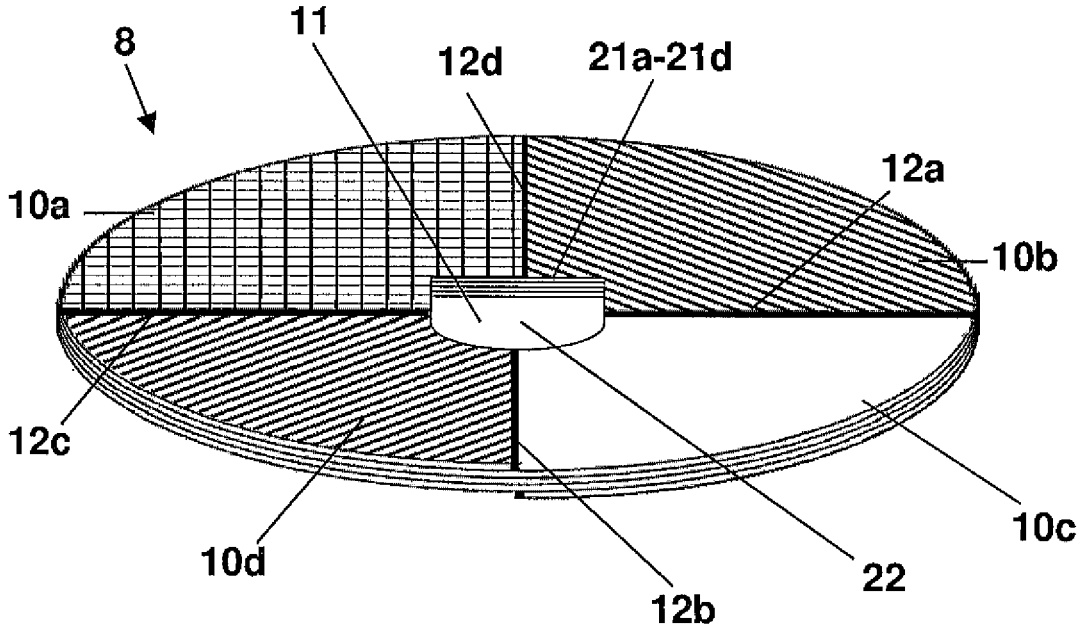
FIG. 10 shows a fourth tool with four mutually overlapping ring disks according to FIG. 9 in a perspective view.

FIG. 9 shows four circular ring disks 10*a* to 10*d* according to a fourth embodiment. The felt ring disk 10*a*, the grinding ring disk 10*b*, the nonwoven ring disk 10*c* and the polishing ring disk 10*d* are composed of materials as explained in the description of FIG. 7. The incisions 12*a* to 12*d* reach from the outer circumference 13 up to the inner circumference 14. The width of the wedge-shaped incisions 12*a* to 12*d* decreases from the inner circumference 14 to the outer circumference, with the narrowest point of the incisions 12*a* to 12*d* corresponding to the thickness of two mutually stacked ring disks 10*a* to 10*d*. The centric openings 11 are semicircular in all ring disks 10*a* to 10*d*. The straight side of the semicircular openings 11 is respectively used as adjusting aids 21*a* to 21*d*. The incisions 12*a* to 12*d* are disposed in four ring disks 10*a* to 10*d* to be offset by 0, 90, 180 and 270° to the straight side of the semicircular adjusting aids 21*a* to 21*d*. When the four ring disks 10*a* to 10*d* are stacked above one another and are displaced into each other to such an extent that the adjusting aids 21*a* to 21*d* cover one another, the angular offset of the incisions 12*a* to 12*d* in relation to the incisions of the respectively next ring disk 10*a* to 10*d* is set at 90°. The semicircular adjusting pattern 22 which is obtained when all ring disks 10*a* to 10*d* are arranged in such a way that the angular offset of the respectively next incisions is 90° with respect to each other is shown in FIG. 10.

Figure 11:
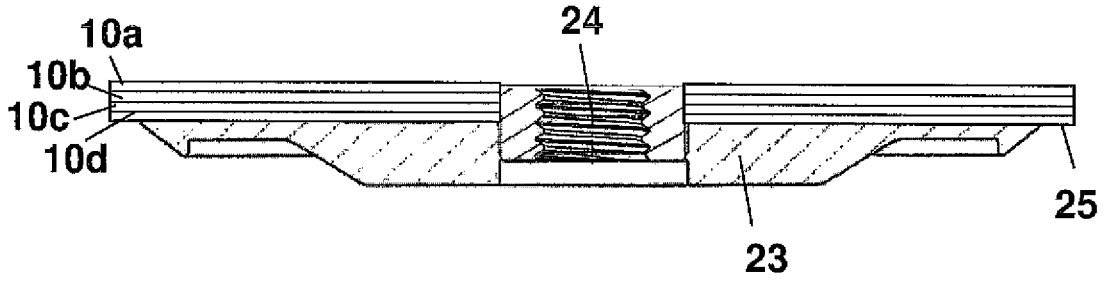
FIG. 11 shows a fifth tool on a supporting disk in a cross-sectional view.

The tools made of disks 19 or ring disks 10 according to FIGS. 4, 6, 8 and 10 can be applied to supporting disks in order to stabilize the disks 19 or ring disks 10 arranged for metal-cutting and to thereby improve the transmission of forces from the tool to the material surface during the cutting process. FIG. 11 shows a tool according to FIGS. 8 and 10 consisting of four mutually inserted and overlapping ring disks 10*a* to 10*d*, which are glued by means of a hot adhesive to a supporting disk 23 which consists of a natural fiber compound. The diameter of the ring disks 10*a* to 10*d* is larger than the diameter of the supporting disk 23, thus leading to an excess portion 25 of the ring disks 10*a* to 10*d*. The supporting disk can be attached to a drive shaft of a drive machine (not shown) by means of a centric thread 24. The direction of rotation of the aforementioned tools is counter-clockwise in order to prevent pitching and jamming of the incisions 12.

What is claimed is:

1. A rotationally symmetrical tool for cutting material surfaces with several disks or ring disks arranged for metal-cutting, which each comprise, an incision originating from an outer circumference, have a common rotational axis and are stacked in a partly overlapping manner on top of one another in such a way that a portion of one respective disk or ring disk comes to lie on top through the incision of a next disk or ring disk arranged above, with the incisions of the disks or ring disks being angularly offset, wherein the incision reaches up to a center point of the disks or an inner circumference of the ring disks, and wherein an angular offset to the incision of a respectively next disk or ring disk is equal to $\alpha=360°/n$, with n being the number of the disks or ring disks.

2. A tool according to claim 1, wherein the number of the disks or ring disks is three to six, preferably four to five.

3. A tool according to claim 1, wherein the incisions of the disks or ring disks widen towards the outer circumference.

4. A tool according to claim 1, wherein the incisions of the discs or ring disks radially extend from the outer circumference to the center point of the discs or the inner circumference of the ring discs.

5. A tool according to claim 1, wherein the disks or ring disks comprise adjusting aids which determine the angular offset.

6. A tool according to claim 5, wherein the adjusting aids jointly form an adjusting pattern which is obtained by an alignment of the disks or ring disks which corresponds to the angular offset.

7. A tool according to claim 1, wherein the disks or ring disks are glued together at least in part.

8. A tool according to claim 7, wherein an adhesive is applied in places close to the incision of a disk or ring disk.

9. A tool according to claim 1, wherein an upper and lower cover surface of the disks or ring disks has active cutting properties.

10. A tool according to claim 1, wherein at least one disk or at least one ring disk comprises a nonwoven or felt material.

11. A tool according to claim 1, wherein at least one disk or at least one ring disk consists of a support and material machining coating.

12. A tool according to claim 11, wherein the material machining coating consists of an abrasive with a grit of 35 to 60 (according to ISO 6344).

13. A tool according to claim 11, wherein the material machining coating comprises ceramic components.

14. A tool according to claim 1, wherein active cutting properties of at least two disks or at least two ring disks differ from one another.

15. A tool according to claim 1, wherein the disks or ring disks are arranged on a supporting disk.

16. A tool according to claim 15, wherein the disks or ring disks are connected with the supporting disk via a detachable adhesive or a hook-and-loop fastener.

17. A tool according to claim 15, wherein the supporting disk comprises natural fibers.

* * * * *